US007069752B2

(12) United States Patent
Clark et al.

(10) Patent No.: US 7,069,752 B2
(45) Date of Patent: Jul. 4, 2006

(54) AUGER AGITATOR ASSEMBLY

(75) Inventors: Douglas S. Clark, Carbondale, IL (US); Jon D. Strait, Carbondale, IL (US); Vicki A. Rogers, Marion, IL (US); Inho Andy Shin, Cleveland, TN (US); Lisa Hood, Newton, IA (US)

(73) Assignee: Maytag Corporation, Newton, IA (US)

( * ) Notice: Subject to any disclaimer, the term of this patent is extended or adjusted under 35 U.S.C. 154(b) by 519 days.

(21) Appl. No.: 10/205,377

(22) Filed: Jul. 23, 2002

(65) Prior Publication Data

US 2004/0016267 A1 Jan. 29, 2004

(51) Int. Cl.
*D06F 17/08* (2006.01)

(52) U.S. Cl. ..... 68/133; 192/46

(58) Field of Classification Search ..... 68/17 A, 68/131–134; 74/21; 192/46
See application file for complete search history.

(56) References Cited

U.S. PATENT DOCUMENTS 3,724,242 A * 4/1973 Davis ..... 68/17 A
3,987,508 A 10/1976 Platt
3,987,651 A 10/1976 Platt
3,987,652 A 10/1976 Ruble
4,018,067 A 4/1977 Vona, Jr. et al.
4,048,820 A * 9/1977 Pielemeier ..... 68/133
4,068,503 A 1/1978 Platt
4,155,228 A 5/1979 Burgener, Jr. et al.
4,164,130 A * 8/1979 Hammer ..... 68/133
4,338,802 A 7/1982 Ohmann et al.
4,693,095 A * 9/1987 Burk et al. ..... 68/134
4,718,258 A * 1/1988 Mason et al. ..... 68/133
4,719,769 A 1/1988 Pielemeier et al.
4,779,431 A * 10/1988 Burk et al. ..... 68/12.16
D300,969 S 5/1989 Bergeson
4,856,303 A 8/1989 Hood, Jr. et al.
5,440,903 A 8/1995 Kropf et al.
5,611,221 A 3/1997 Tremel
D381,140 S 7/1997 Pinkowski et al.
5,651,278 A 7/1997 Pinkowski
5,784,902 A 7/1998 Pinkowski et al.
D423,740 S 4/2000 Euler et al.
6,212,722 B1 4/2001 Pinkowski et al.
6,497,121 B1 * 12/2002 Walsh et al. ..... 68/19.2

* cited by examiner

*Primary Examiner*—Joseph L. Perrin
(74) *Attorney, Agent, or Firm*—McKee, Voorhees & Sease, P.L.C.

(57) ABSTRACT

An agitator assembly includes an agitator body and an auger body mounted on the upper end of the agitator body. There are at least three separate helical flighting segments on the auger body. Bearings are provided at the upper end of the auger body and at the lower end of the auger body. At least one of the bearings limits both radial and axial movement of the auger relative to the agitator whereas the other of the bearings limits only radial movement of the auger relative to the body. Inlet openings are provided adjacent the lower surfaces of the auger flightings permit fluid to enter the interior of the auger barrel. An elastomeric ring is provided for attaching a fabric softener dispenser to the agitator assembly and for permitting grasping and removal of the dispenser.

8 Claims, 5 Drawing Sheets

AUGER AGITATOR ASSEMBLY

BACKGROUND OF THE INVENTION

This invention relates to an auger agitator assembly.

Fabric washing machines have traditionally utilized an agitator assembly in the center of a washing tub. One type of washing machine uses an agitator assembly that rotates about a vertical axis in a reciprocating fashion, first moving one rotational direction, and then reciprocating back in the opposite direction. Auger tubes have been provided in the prior art on the upstanding portion of the agitator base. These auger tubes have helical auger flightings on their outer surfaces. A clutch assembly is between the auger tube and the agitator base. The clutch permits the auger to rotate in a single rotational direction in response to the agitating movement of the agitator base. When the agitator base rotates in a first direction the auger tube moves in unison with it, and when the agitator base rotates in the opposite direction the auger tube slips and does not rotate. Thus the agitator base reciprocates back and forth whereas the auger tube rotates only in one direction.

A fabric softener dispenser is sometimes mounted on the upper end of the agitator assembly. It dispenses fabric softener into the center of the auger agitator assembly after the assembly is spun at high speed at the end of the wash portion of the cycle.

During the operation of the washing machine the auger flightings impart downward movement to the fabrics being washed so that the fabrics move downwardly adjacent the auger agitator assembly and then rise adjacent the inner radial wall of the washing tub. This imparts a cyclical motion to the fabrics, causing them to move down near the auger agitator body, then move radially outwardly and then rise upwardly to the top of the washing tub. This cyclical movement is referred to as "turnover" of the fabrics.

One problem in achieving turnover is the need for adequate flighting or other means on the auger body for forcing the fabrics downwardly. Another need is the ability to keep the auger and the clutch properly centered on the agitator body during operation. Also the clutch includes two clutch rings which need to be maintained properly aligned and centered. Proper fluid circulation within the barrel of the auger body and the interior of the agitator body is also desirable for purposes of flushing fluid fabric softener from the interior of the auger agitator assembly into the washing fluid containing the fabrics.

The fabric softener dispenser should be easy to grasp and remove from the auger agitator assembly. However, when wet, most plastics from which the dispensers are made are often slippery and difficult to grasp. Also a satisfactory apparatus is desirable for detachably securing the dispenser to the auger agitator assembly.

Therefore, a primary object of the present invention is the provision of an improved auger agitator assembly.

A further object of the present invention is the provision of an auger agitator assembly wherein three separate flighting segments are provided on the outer surface of the auger so as to facilitate the downward movement of clothing in the washing cycle.

A further object of the present invention is the provision of an auger agitator assembly having ribs on the outer surface of the auger assembly and also on the outer surface of the flexible fins near the bottom of the agitator assembly for further aiding the agitation of the clothing and fabrics within the washer.

A further object of the present invention is the provision of an improved bearing system for mounting the auger barrel rotatably to the upstanding post within the agitator base.

A further object of the present invention is the provision of upper and lower bearings between the auger and the agitator base, the bearings providing satisfactory rotation between the two members, but one of the bearings limiting both the axial and radial movement of the auger barrel relative to the agitator base and the other of the bearings limiting only radial movement.

A further object of the present invention is the provision of holes in the auger tube wall to facilitate the flushing of fluid fabric softener from the interior of the agitator to the washing fluid containing the fabrics.

A further object of the present invention is the provision of a fabric softener dispenser which includes an elastomeric ring around the outside thereof for facilitating the gripping and removal of the fabric softener from the top of the auger agitator assembly.

A further object of the present invention is the provision of an improved fabric softener dispenser which utilizes an elastomeric ring for detachably securing the fabric softener dispenser to the upper end of the auger assembly.

A further object of the present invention is the provision of an improved auger agitator assembly which is efficient in operation, durable in use, and economical to manufacture.

BRIEF SUMMARY OF THE INVENTION

The foregoing objects may be achieved by an agitator assembly for a fabric washer comprising an agitator body having an upstanding axis. An auger body is mounted for rotation with respect to the agitator body about the upstanding axis of the agitator body. A drive motor is operatively connected to the agitator body for causing reciprocating movement of the agitator body in first and second opposite rotational directions around the upstanding axis. A clutch between the auger body and the agitator body causes the auger body to rotate in the first rotational direction in response to rotation of the agitator body in the first rotational direction. The clutch also causes lost rotational movement between the auger body and the agitator body when the agitator body rotates in the opposite rotational direction. There are at least three segments of helical flightings on the auger body.

According to another feature of the present invention, the clutch includes a clutch bearing comprising first and second clutch bearing surfaces adapted to bear against one another during relative rotational movement between the agitator body and the auger body. A lower bearing is provided on the auger body spaced axially from the clutch bearing along the upstanding axis of the agitator body. The lower bearing comprises first and second bearing surfaces adapted to bear against one another during relative rotational movement between the agitator body and the auger body. One of the clutch bearing or the lower bearing limits only radial movement of the auger body relative to the upstanding axis of the agitator body. The other of the clutch bearing or lower bearing limits both axial and radial movement of the auger body relative to the upstanding axis of the agitator body.

According to another feature of the invention, the one of the clutch bearing or lower bearing which limits both axial and radial movement includes two tapered bearing surfaces which bear against one another.

According to another feature of the present invention, the auger tube includes tube walls surrounding a tube cavity and one or more tube wall holes providing fluid communication from outside the tube walls to the inside of the tube cavity.

According to another feature of the present invention, the tube wall holes are located in close proximity to the helical flighting extending around the auger tube, and immediately below the helical flighting.

According to another feature of the present invention, the auger assembly includes a dispenser at its upper end having a first portion within the tube cavity and having a second portion extending upwardly to the opening above the upper edge of the auger tube wall. The dispenser includes an upwardly facing dispenser opening above the upper edge of the tube wall and is comprised of a material having a first durometer reading and a first coefficient of friction. An annular ring surrounds and engages the dispenser at the outer circumference and comprises a gripping surface of the elastic material having a second durometer reading and a second coefficient of friction. The second durometer reading of the annular ring is lower than the first durometer reading of the dispenser. The second coefficient of friction of the annular ring is higher than the first coefficient of friction of the dispenser.

According to another feature of the present invention, the annular ring comprises an elastic material which is stretched in an outward radial direction and exerts an inward radial force against the tube wall and the dispenser to detachably secure the dispenser to the tube wall.

DETAILED DESCRIPTION OF THE INVENTION

Figure 1:
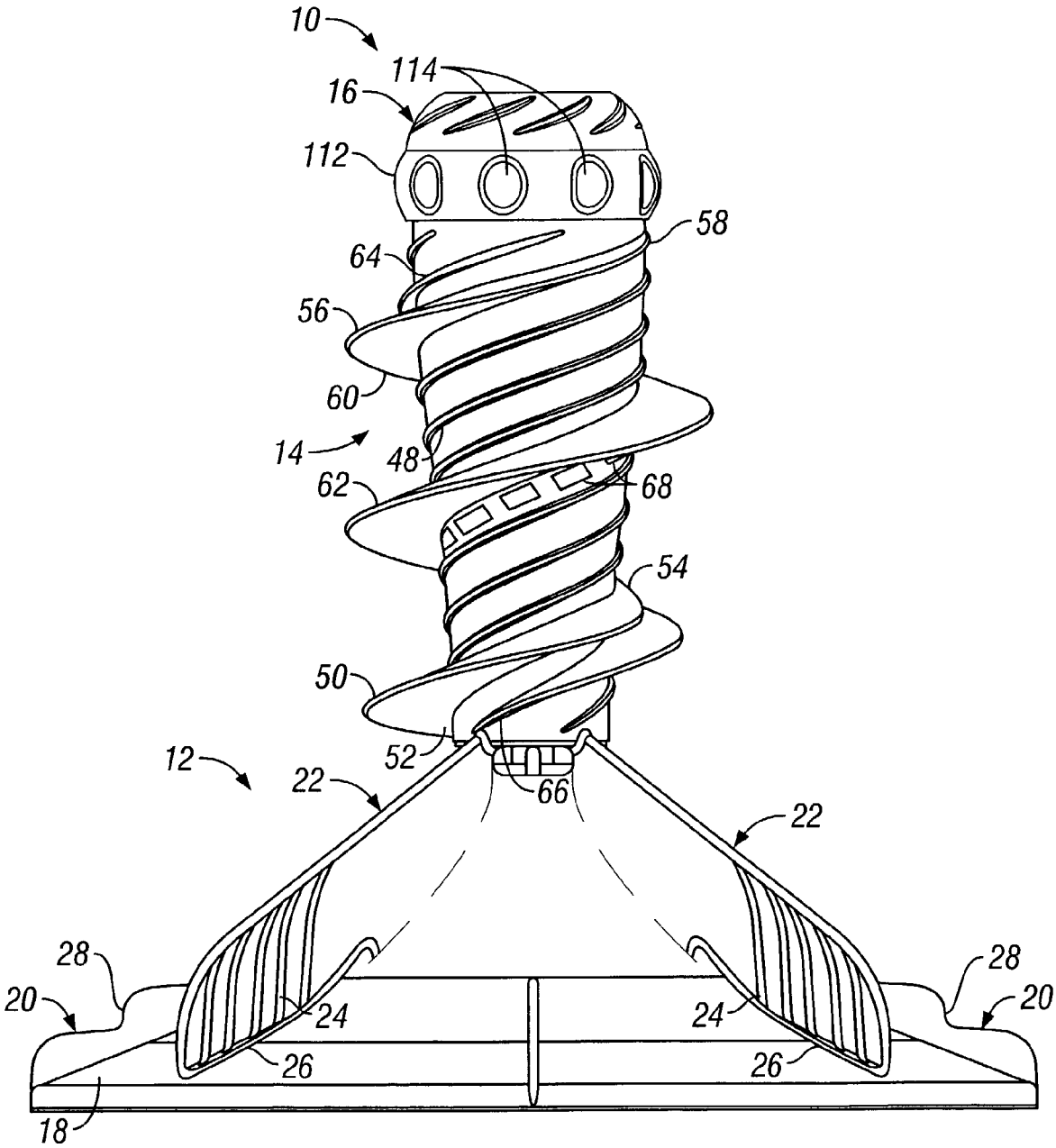
FIG. 1 is a front elevational view of the agitator assembly of the present invention.

Referring to the drawings the numeral 10 generally designates an auger agitator assembly. Assembly 10 includes an agitator body 12, an auger body 14, and a softener dispenser 16.

Agitator body 12 comprises an apron 18 having a plurality of fixed fins 20 (preferably four). Apron 18 also includes a plurality of flexible fins 22, also preferably four. The flexible fins 22 include ribbed surfaces 24 which facilitate the agitation by increasing the mechanical energy imparted to the fabrics being washed. Beneath the outer ends of flexible fins 22 are grooves 26 which enable the flexible fins 22 to flex in response to encountering the fabrics being washed. The grooves 26 represent regions where the flexible fins 22 are unattached to the apron 18.

The material for forming the agitator assembly 10 is preferably a plastic material. The plastic material may vary without detracting from the invention, but a certain amount of flexibility is preferable so as to enable the flexible fins 22 to flex in response to encountering the fabrics being washed.

Figure 2:
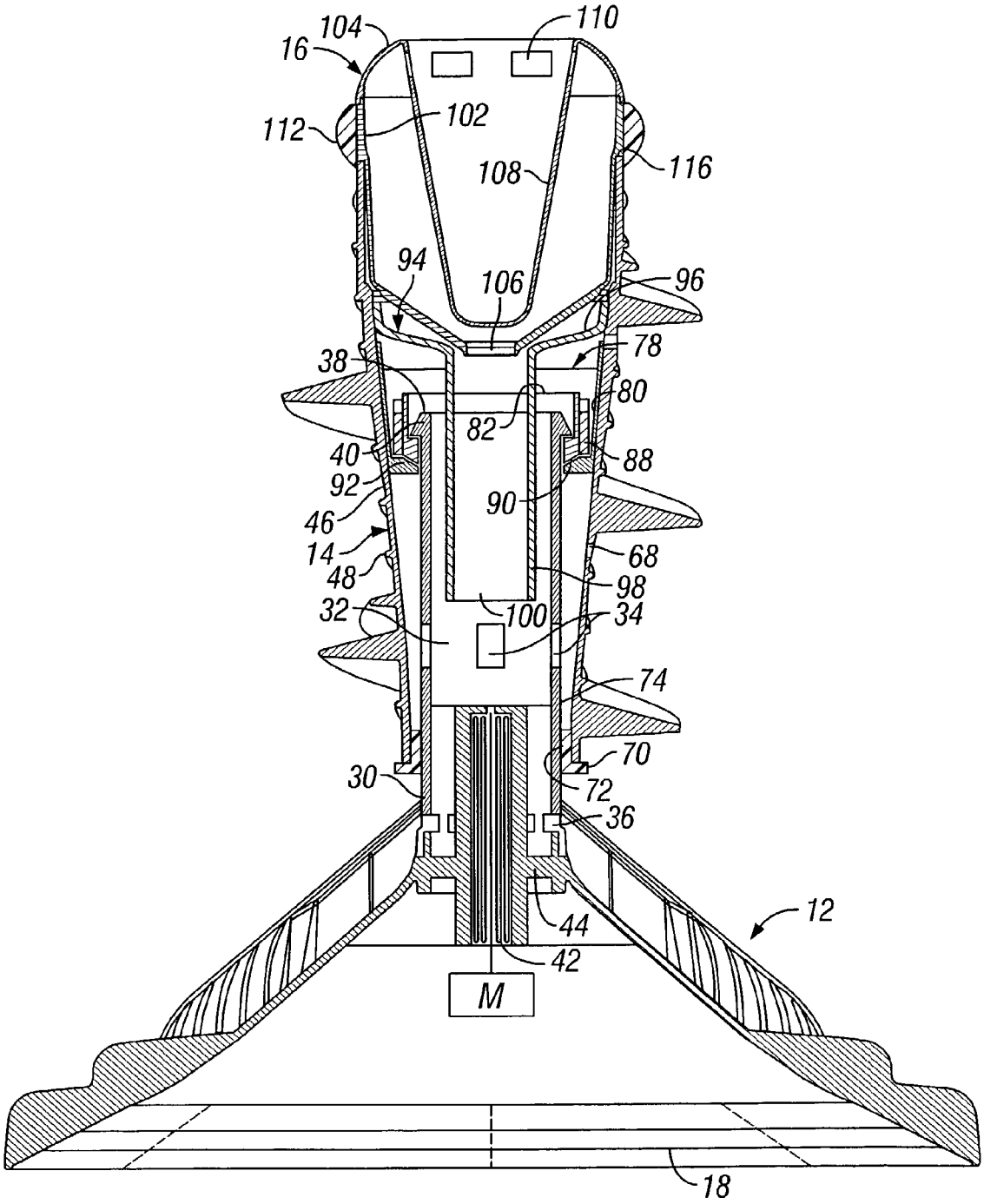
FIG. 2 is a vertical section through the agitator assembly, showing a motor schematically for driving the agitator assembly.
Figure 3:
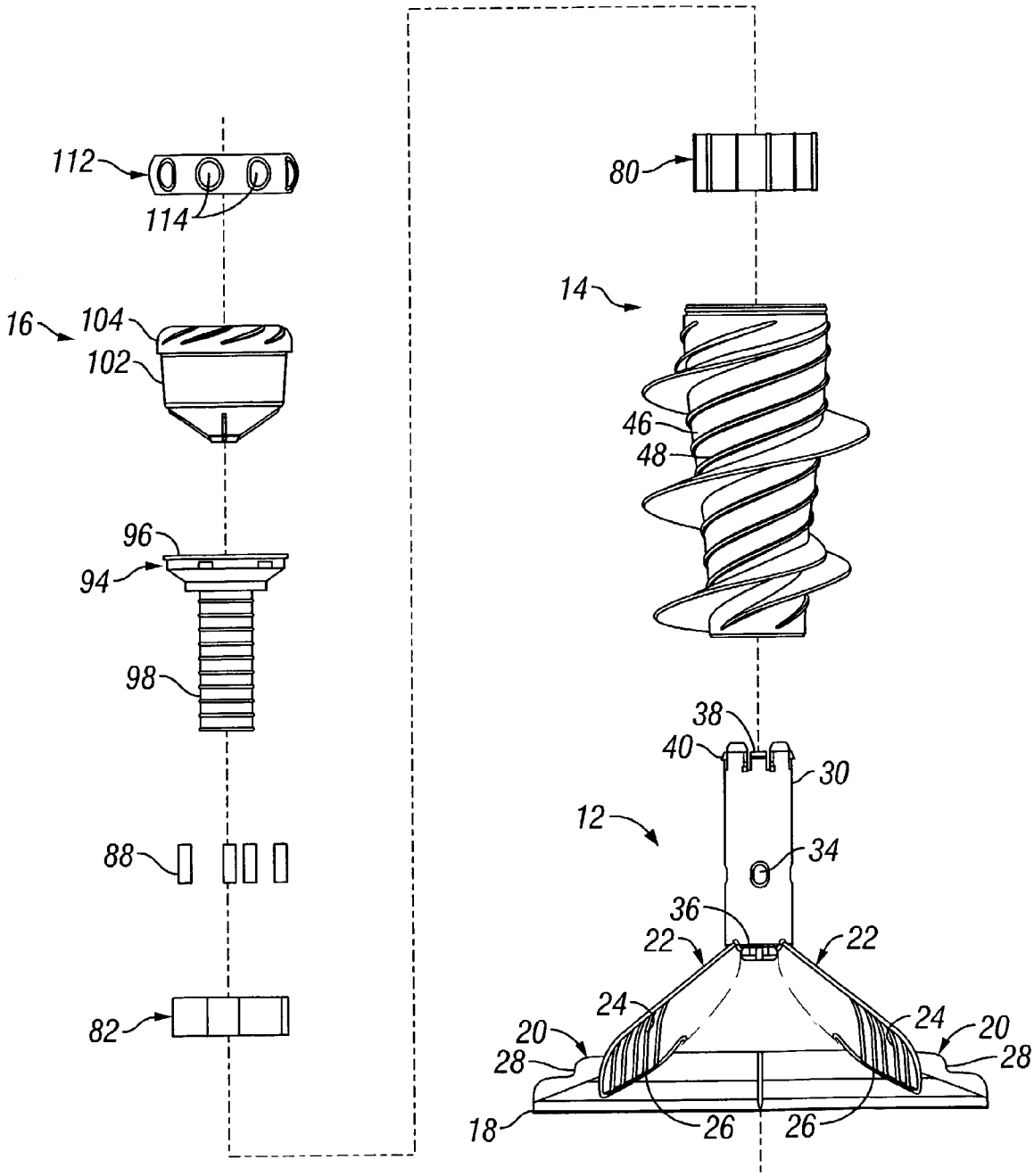
FIG. 3 is an exploded elevational view of the agitator assembly.

The fixed fins 20 include upwardly presented scalloped or stepped edges 28. Extending upwardly from the apron 18 is an upstanding post 30 which is tube shaped and which includes a post cavity 32 (FIG. 2) therein. Post 30 includes a plurality of upper drain holes 34 and lower drain holes 36 which permit washing fluid to enter the interior of the post cavity 32 from the exterior of the agitator. At the upper end of the upstanding post 30 are a plurality of spring fingers 38 having pawls 40 on their upper ends. As can be seen in FIG. 2 the skirt or apron 18 includes a centrally located splined receptacle 42 which extends through a bottom wall 44.

Motor M is adapted to drive agitator body 12 in a reciprocating rotational movement, first one direction and then an opposite direction. Suitable transmissions or other connecting devices (not shown) may be placed between motor M and agitator body 12 to accomplish this reciprocating motion.

Auger body 14 includes a tapered barrel wall 46 having a plurality of helical ribs 48 extending upwardly along the length thereof. Ribs 48 facilitate the agitation of the clothing or fabrics being washed. Auger 14 also includes three flight segments, a lower flight segment 50, an upper flight segment 56, and a full length flight segment 62. The lower flight segment 50 includes a lower end 52 and an upper end 54. The opposite ends of lower flighting 50 as well as the flightings 56 and 62 all begin closely adjacent the barrel wall 46 and progress radially outwardly. The upper flight segment 56 includes an upper flight end 58 and a lower flight end 60 both of which begin adjacent the auger barrel wall 46 and progress radially outwardly towards the center of the flighting 56. Full flight 62 includes an upper end 64 and a lower end 66 also which are closely adjacent the auger barrel wall 46.

Beneath the flighting 62 are a plurality of inlet openings 68. The location of these inlet openings in close proximity to the working surface of the helical flight 62 allows water to filter through the auger barrel and be pumped downward as the agitator is rotated back and forth. This water pumping action will improve engagement between the auger and the fabrics being washed. The pumping action will also allow some rinsing to occur inside the agitator post cavity 32 to clean the residual fabric softener fluid and distribute it out through the washing fluid surrounding auger agitator body 10.

Fitted and secured within the lower end of the auger barrel 46 is a lower bearing member 70 having a first bearing surface 72 which bears against a second bearing surface 74 on the lower end of the agitator post 30. These two bearing surfaces 72, 74 restrict only radial movement of the auger 14 with respect to the agitator body 12, but do not restrict axial or rotational movement.

Figure 4:
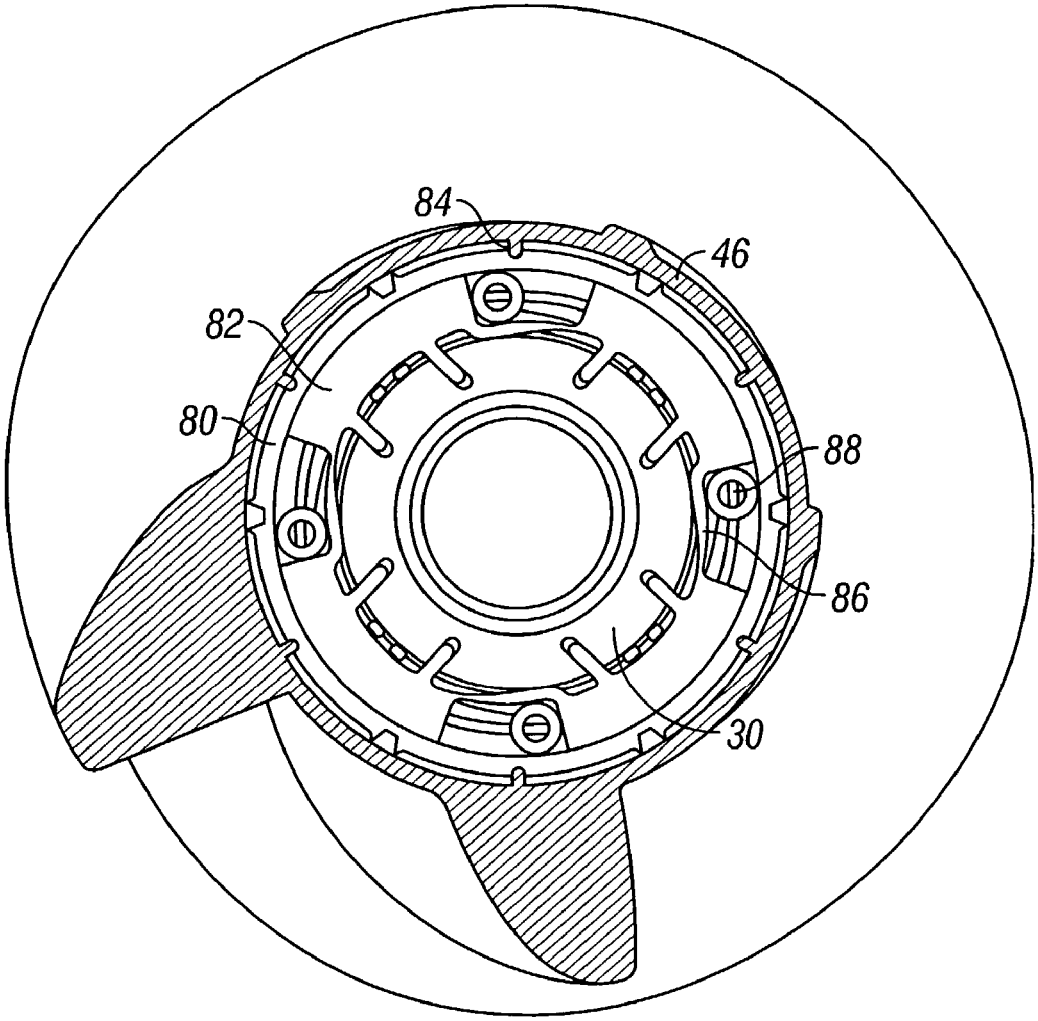
FIG. 4 is a sectional view through the auger tube to display a top view of the clutch mechanism for transmitting rotational movement from the agitator to the auger.

Within the auger barrel 46 is a clutch assembly 78 which is adapted to control the rotational movement between the agitator 12 and the auger 14. Clutch assembly 78 includes an outer clutch ring 80 and an inner clutch ring 82. The outer clutch ring 80 is attached to the auger barrel 46 by means of a plurality of splines 84 (FIG. 4). Thus the outer clutch ring 80 rotates in unison with the auger barrel 46. The inner clutch ring 82 is attached to the agitator post 30 by means of the spring fingers 38 and pawls 40. These spring fingers 38 and pawls 40 engage the inner clutch ring and prevent its axial movement relative to the auger post 30 and also prevent rotational movement with respect to auger 30. Thus the inner clutch ring 82 rotates in unison with the agitator post 30.

The motor M causes the agitator body 12 to rotate in a reciprocating rotational movement, moving first one rotational direction and then reversing to the opposite rotational direction. The clutch assembly 78 transfers the rotational movement of the agitator body 12 to the auger 14 when it is moving in one direction, and permits slippage of the auger 14 relative to the agitator 12 when the agitator is moving in the opposite direction. Thus the agitator body 12 reciprocates back and forth whereas the auger body 14 rotates in only one direction. This rotational movement of the auger body 14 is intermittent, occurring only when the agitator body moves in one of its two rotational directions. A plurality of tapered roller slots 86 (FIG. 4) are provided between the inner clutch ring 82 and the outer clutch ring 80. Within these tapered roller slots 86 are plastic rollers 88. These plastic rollers become compressed when the relative rotation of the agitator body and the auger is in one direction and the rollers 88 move to the wider portion of the tapered slots 86 when the relative rotation is in the opposite direction. When the rollers are compressed they transfer rotational movement from the agitator 12 to the auger 14. However, when they are loose they do not transfer rotation and the agitator 12 is permitted to rotate independently of the auger 14.

As can be seen in FIG. 2, the inner clutch ring 82 includes a tapered bearing surface 90 and the outer clutch ring 80 includes a tapered bearing surface 92. Surfaces 90, 92 bear against one another during the relative rotation between the agitator body 12 and the auger body 14. Because of the tapered nature of these surfaces 90, 92, they provide a bearing which limits the relative movement of the auger body 14 and the agitator body 12 in both a radial direction and in an axial direction. They permit only rotational relative movement between the two.

Thus the tapered bearing surfaces 90, 92 limit both the axial and radial direction relative movement of the auger body 14 relative to the agitator body 12, and the lower bearing surfaces 72, 74 limit only radial movement of the two members.

A closure member 94 is spin welded within the auger barrel 46 and includes an apron 96 and a downwardly extending tube 98 having an open lower end 100.

Softener dispenser 16 includes a dispenser container 102 having a dispenser lid 104 spin welded thereon. Dispenser container 102 includes a bottom hole 106. The dispenser lid 104 includes an upwardly presented cone shaped cup 108. Adjacent the upper edge of cone shaped cup 108 are a plurality of dispensing holes 110. Surrounding the softener dispenser 16 is an elastomeric annular ring 112 having a plurality of finger receiving depressions 114 therein. The annular ring 112 is formed of an elastic flexible material that has a durometer reading substantially lower than the durometer reading of the dispenser 16. Also, the coefficient of friction of the annular ring 112 is considerably higher than the coefficient of friction of the softener dispenser 16. This enables the operator to grip the annular ring 112 and hold it much more easily than is the case with the slippery surface of the dispenser 16. The finger depressions 114 also facilitate this frictional engagement.

The annular ring 112 also frictionally engages the dispenser 16 and the upper edge 116 of the auger barrel 46. This detachably secures the dispenser 16 within the upper end of the auger barrel 46. However, the operator may grip the annular ring 112 and lift the dispenser 16 upwardly out of the barrel 46 for servicing.

Liquid fabric softener is placed within cone shaped cup 108. During rotation of the auger agitator assembly 10 during the spin cycle of the washing machine, the liquid fabric softener rises in cup 108 and spills out through dispensing holes 110. Due to centrifugal force, the liquid is held within the dispenser container 102 until the spin cycle ends. It then falls down through dispenser container 102 and passes through opening 106 into the post cavity 32.

Figure 5:
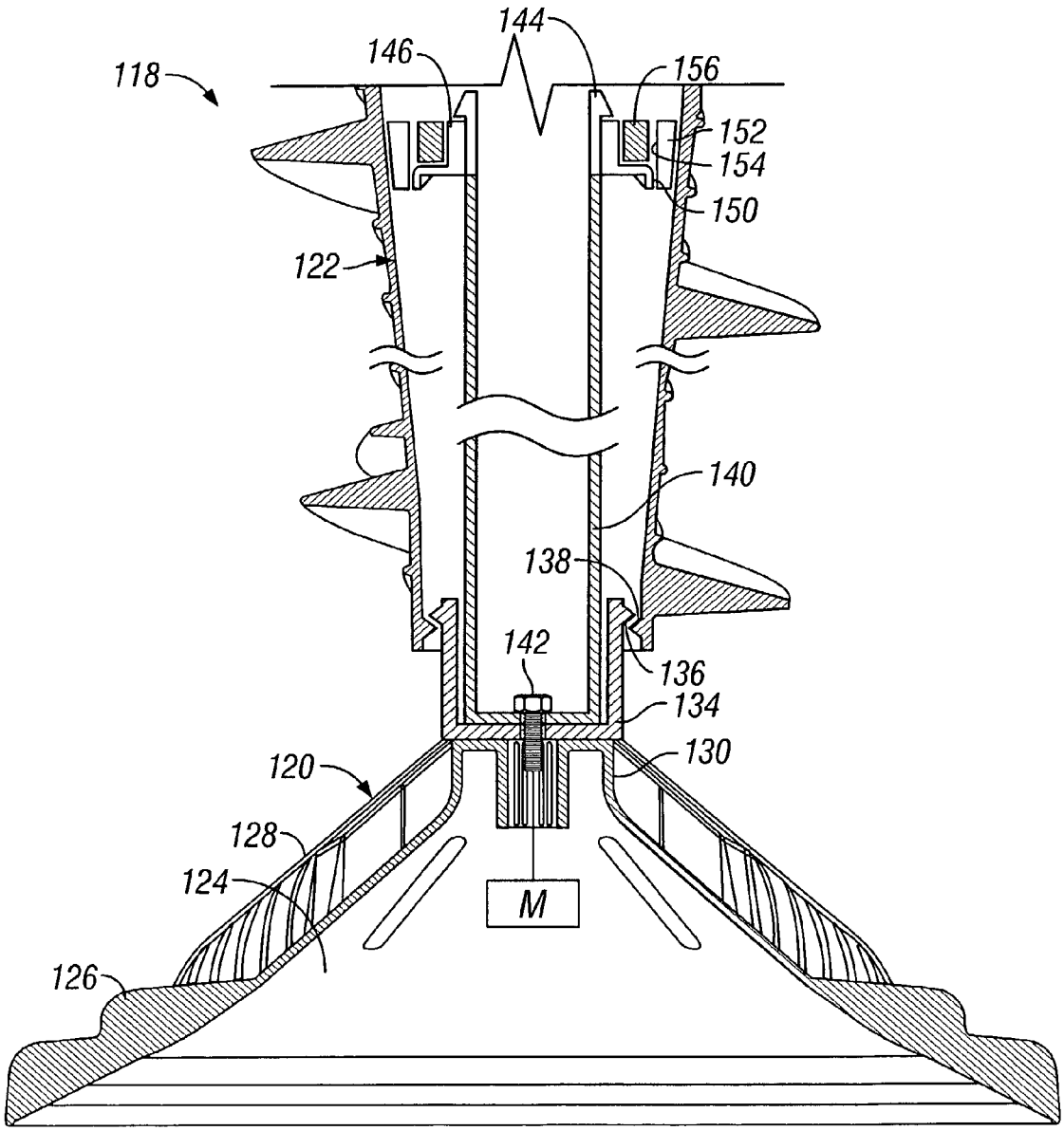
FIG. 5 is a sectional view similar to FIG. 2, but showing a modified form of the invention.

Referring to FIG. 5 a modified form of the present invention is shown and is designated by the numeral 118. Modified assembly includes an agitator body 120, and an auger body 122. Agitator body 120 includes an apron 124 having fixed fins 126 and flexible fins 128 thereon. Extending upwardly from the apron 124 is an upstanding lower post 130. Resting on the upper end of lower post 130 is a cup shaped bearing member 134 having an annular tapered bearing surface 136 extending around its upper edge. The tapered surface 136 is adapted to bear against a similar inwardly extending tapered bearing surface 138 on the inside of the auger body 122. These two bearing surfaces 136, 138 limit both radial and the axial movement of the auger body 122. During the rotation of the auger body 122, the flightings force the fabrics being washed downwardly, and the fabrics in response exert an upward force on the auger 122 attempting to lift the auger 122 upwardly. Bearing surfaces 136, 138 prevent this upward axial movement while at the same time preventing radial movement.

Extending upwardly from the cup shaped bearing 134 is an upstanding post 140 which is held in place by bolt 142 extending through the upstanding post 140, the U-shaped cup 134, the lower post 130, and being threaded into the shaft from motor M.

Bearing 134 is made of a different plastic than the plastic of auger body 122 and agitator body 120. It should be noted that bearing surface 136 is shown on cup-shaped bearing 134 to confine the relatively expensive plastic bearing material to a small component. If the material cost were not prohibitive, bearing surface 136 could be included directly on upstanding post 140, thereby eliminating cup shaped bearing 134.

The upper end of the agitator post 140 is provided with pawl fingers which engage an inner clutch ring 146. Clutch ring 146 includes a bearing surface 150 facing in an outward radial direction. Bearing surface 150 bears against bearing surface 154 facing in an inner radial direction on the outer clutch ring 152. Plastic rollers 156 are similarly provided. As can be seen in FIG. 5, the lower bearing surfaces 136, 138 prevent both radial and axial movement whereas the upper bearing surfaces 150, 154 prevent only radial limitations during the rotational movement of the auger 122 relative to the agitator 120. The closure member 94 (not shown in FIG. 5, but shown in FIG. 2) limits the downward movement of auger body 122 on agitator body 120 when the auger agitator assembly is at rest.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. An agitator assembly for a fabric washer comprising:

an agitator body having an upstanding axis;

an auger body mounted for rotation relative to the agitator body about the upstanding axis of the agitator body;

a drive motor operatively connected to the agitator body for causing reciprocating movement of the agitator body in first and second opposite rotational directions around the upstanding axis;

a clutch between the auger body and the agitator body for causing the auger body to rotate in the first rotational direction in response to rotation of the agitator body in the first rotational direction and for causing lost rotational motion between the auger body and the agitator body when the agitator body rotates in the opposite rotational direction;

the clutch having a clutch bearing comprising first and second clutch bearing rings adapted to bear against one another during relative rotational movement between the agitator body and the auger body;

a lower bearing on the auger body spaced axially from the clutch bearing along the upstanding axis of the agitator body, the lower bearing having a bearing surface adapted to bear against a bearing surface of the agitator body during relative rotational movement between the agitator body and the auger body;

one of the clutch bearing and the lower bearing limiting only radial movement of the auger body relative to the upstanding axis of the agitator body; and the other of the clutch beating and lower bearing limiting both axial and radial movement of the auger body relative to the upstanding axis of the agitator body.

2. An agitator assembly according to claim 1 wherein the clutch bearing limits both axial and radial movement of the auger body relative to the agitator body and the lower bearing limits only radial movement of the auger body relative to the agitator body.

3. An agitator assembly according to claim 2 wherein the first and second clutch bearing rings are tapered with respect to the upstanding axis of the agitator body.

4. An agitator assembly according to claim 1 wherein the lower bearing limits both axial and radial movement of the auger body relative to the agitator body and the clutch bearing limits only radial movement of the auger body relative to the agitator body.

5. An agitator assembly according to claim 4 wherein the bearing surfaces of the lower bearing and the agitator body are tapered with respect to the upstanding axis of the agitator body.

6. An agitator assembly for agitating a washing fluid having a plurality of articles to be washed therein comprising:

an agitator body having an upstanding axis;

an auger body comprising an auger tube having upper and lower ends and having three or more helical flighting segments extending around the auger tube, the auger body being mounted for rotation about the upstanding axis of the agitator body;

a drive motor operatively connected to the agitator body for causing reciprocating movement of the agitator body in first and second opposite rotational directions;

a clutch between the auger body and the agitator body for causing the auger body to rotate in the first rotational direction in response to rotation of the agitator body in the first rotational direction and for causing lost rotational motion between the auger body and the agitator body when the agitator body rotates in the opposite rotational direction;

the clutch having a bearing comprising first and second clutch bearing rings bearing against one another during relative rotational movement between the auger body and the agitator body;

the auger tube having a tube wall surrounding a tube cavity and one or more tube wall holes providing fluid communication from outside the tube wall to the tube cavity;

a lower bearing member attached to the lower end of the auger tube, surrounding the upstanding agitator post, and bearing against the agitator body during relative rotational movement between the agitator body and the auger body;

one of the clutch bearing and the lower bearing member limiting only relative radial movement between the agitator body and the auger body; and the other of the clutch bearing and the lower bearing member limiting both relative radial movement and axial movement between the agitator body and the auger body.

7. The agitator assembly of claim 6 wherein the clutch bearing prevents both radial and axial relative movement between the agitator body and the auger body.

8. The agitator assembly of claim 6 wherein the lower bearing prevents both radial and axial relative movement between the agitator body and the auger body.

* * * * *